US007127922B2

(12) United States Patent
Khounsombath et al.

(10) Patent No.: US 7,127,922 B2
(45) Date of Patent: Oct. 31, 2006

(54) KEY UNIT HOLDER

(76) Inventors: Saysamon Khounsombath, 21321 105th Pl. SE., Kent, WA (US) 98031; Vixai Nackviseth, 1231 Eagle La. South #6, Renton, WA (US) 98055

( * ) Notice: Subject to any disclaimer, the term of this patent is extended or adjusted under 35 U.S.C. 154(b) by 0 days.

(21) Appl. No.: 10/896,381

(22) Filed: Jul. 21, 2004

(65) Prior Publication Data

US 2006/0016231 A1 Jan. 26, 2006

(51) Int. Cl.
*A47G 29/10* (2006.01)

(52) U.S. Cl. ..... 70/456 R; 70/456; 7/118; 206/37.2

(58) Field of Classification Search ..... 70/456 R, 70/459, 414, 388, 395, 408; 206/37.2, 37.3, 206/37.4, 38.1, 37.1, 37.5, 37.6, 37.7, 37.8; 7/118; 24/3.6
See application file for complete search history.

(56) References Cited

U.S. PATENT DOCUMENTS 1,885,957 A * 11/1932 Singleton ..... 70/456 R
1,998,799 A * 4/1935 Woina et al. ..... 70/456 R
2,047,331 A * 7/1936 Pollak ..... 70/456 R
2,400,221 A * 5/1946 Bennett ..... 70/456 R
2,433,526 A * 12/1947 MacPherson ..... 70/456 R
2,517,500 A * 8/1950 McPherson et al. ..... 70/456 R
2,690,666 A * 10/1954 Morris et al. ..... 70/456 R
2,696,101 A * 12/1954 Dysart ..... 70/456 R
2,822,684 A * 2/1958 Ray ..... 70/456 R
2,836,053 A * 5/1958 Starrett ..... 70/456 R
3,004,422 A * 10/1961 Starrett ..... 70/456 R
3,173,280 A * 3/1965 Oberacker ..... 70/456 R
3,321,943 A * 5/1967 Reyes ..... 70/456 R
3,354,679 A 11/1967 Le Fave
3,696,649 A * 10/1972 Chow et al. ..... 70/456 R
3,745,799 A 7/1973 Fagiano
4,524,594 A * 6/1985 Bascou ..... 70/456 R
4,569,215 A * 2/1986 McCarthy ..... 70/456 R
4,628,717 A 12/1986 Blum
4,646,913 A 3/1987 Wing et al.
4,706,803 A 11/1987 Wang
5,117,666 A * 6/1992 Keefer ..... 70/456 R
5,215,190 A 6/1993 Hoffpauir, Jr.
5,355,702 A 10/1994 Escribens (Continued)

*Primary Examiner*—Lloyd A. Gall
(74) *Attorney, Agent, or Firm*—Delbert J. Barnard

(57) ABSTRACT

A key unit is received within a key unit receiving cavity in a housing and is pivotally connected to the housing for pivotal movement between a first position in which it is substantially within the key cavity and a second position in which it extends outwardly from or is aligned with an open end in the housing. A key unit mounting pin extends across the cavity and into an opening in the head of the key unit. A spring is positioned in the mounting opening, and includes a helical portion surrounding the mounting pin. The spring has a first end portion connected to the housing and a second end portion connected to the key unit. The key unit is pivotally connected to the housing by said mounting pin, for pivotal movement between a first position in which it is substantially within the key unit receiving cavity, and a second position in which it projects outwardly from the open end of the cavity. The spring biases the key unit into the second position. The key unit is hand movable from the second position into the first position and this movement of the key unit stores energy into the spring. The stored energy in the spring moves the key unit from its first position into its second position.

13 Claims, 5 Drawing Sheets

U.S. PATENT DOCUMENTS 5,487,291 A 1/1996 Voigt
5,495,942 A * 3/1996 Izhak ..... 206/372
5,943,889 A * 8/1999 Chiu ..... 70/456 R
6,237,756 B1 5/2001 Caudle
6,691,539 B1 2/2004 Jacob et al.
6,705,141 B1 3/2004 Jacob et al.
2005/0103070 A1* 5/2005 Meyerson et al. ..... 70/456 R

* cited by examiner 10
30
34
36
40
46
64
76
86
88
90
91
92
94
32
4

68
80
82
84
90

68
80
82
84
90

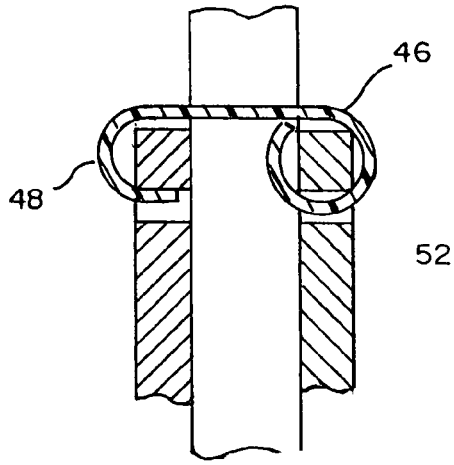
FIG. 8
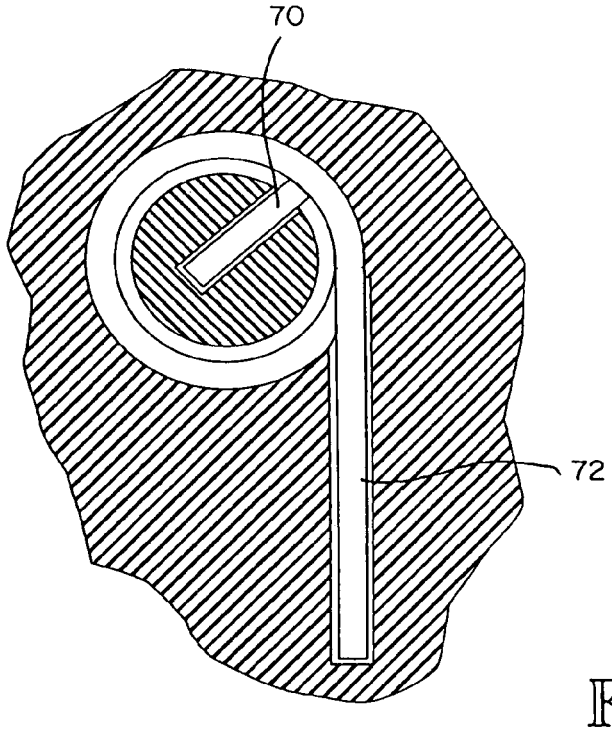
FIG. 9
FIG. 10
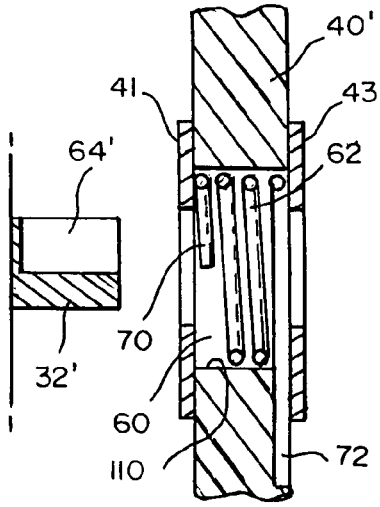

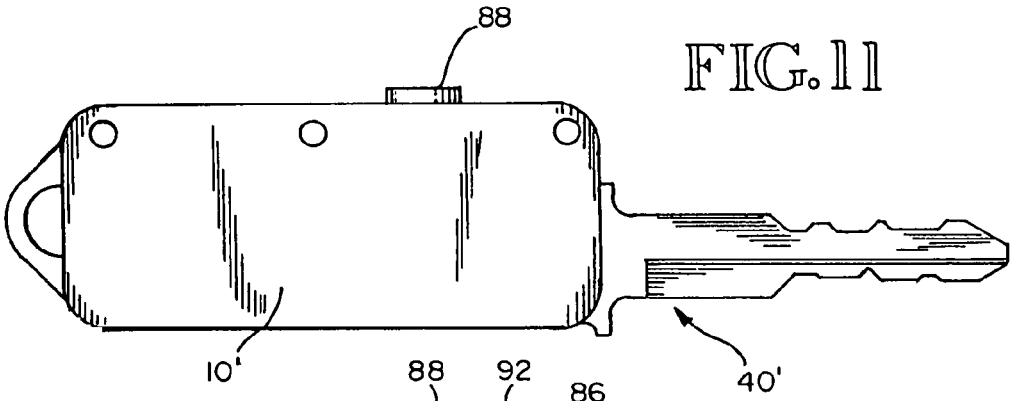
FIG. 11
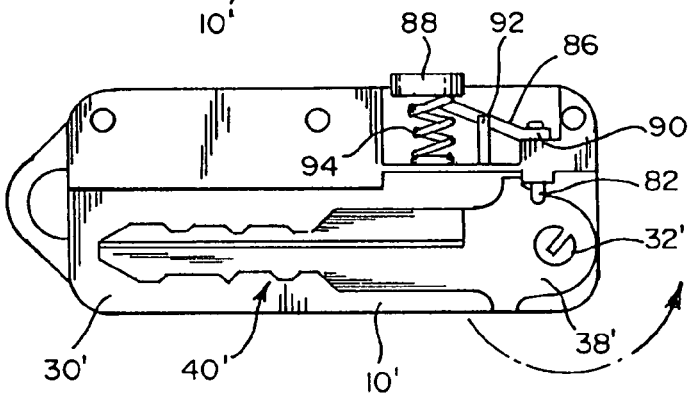
FIG. 12
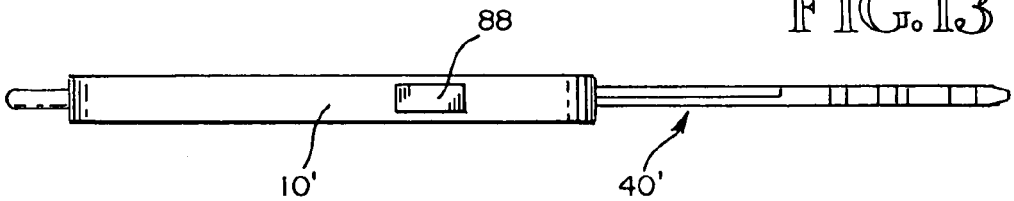
FIG. 13
FIG. 14
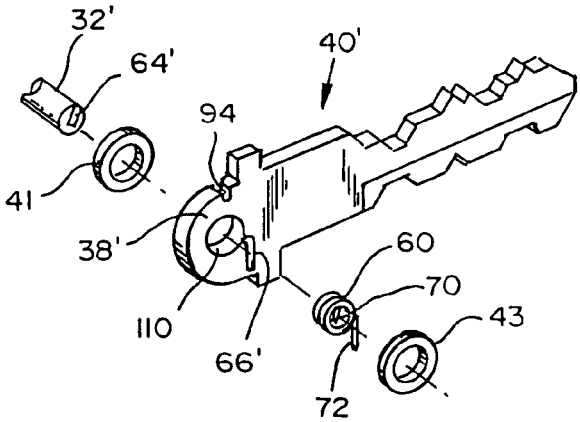

KEY UNIT HOLDER

TECHNICAL FIELD

This invention relates to key unit holders having the general appearance of a pocket knife. More particular, it relates to a such a holder for one or more key units in which each key unit is movable between an extended position and a folded position, is spring biased into its extended position, and includes a releasable lock for holding it in its folded position, said lock when released allowing stored energy in the spring to move the key unit from its folded into its extended position.

BACKGROUND OF THE INVENTION

The key holder art includes key holders for one or more keys in which the keys are each movable between an extended position and a folded position. The following U.S. States patents show example key holders that are in the patent literature: U.S. Pat. No. 3,354,679, granted Nov. 28, 1967, to James E. Le Fave; U.S. Pat. No. 3,745,799 granted Jul. 17, 1973 to Carl R. Fagiano; U.S. Pat. No. 4,628,717 granted Dec. 16, 1986 to Alvin S. Blum; U.S. Pat. No. 4,646,913, granted Mar. 3, 1987, to Russell T. Wing and David H. Palmer; U.S. Pat. No. 4,706,803, granted Nov. 17, 1987 to Shih-Fu Wang; U.S. Pat. No. 5,215,190, granted Jun. 1, 1993, to Raymond Hoffpauir, Jr.; U.S. Pat. No. 5,355,702, granted Oct. 18, 1994 to Augusto Escribens; U.S. Pat. No. 5,487,291, granted Jan. 30, 1996, to Barnard Voigt; U.S. Pat. No. 5,943,889, granted Aug. 31, 1999 to Kuang-Yen Chiu; U.S. Pat. No. 6,237,756 B1, granted May 29, 2001 to Scott Caudle; U.S. Pat. No. 6,691,539, granted Feb. 17, 2004 to Dirk Jacob and Elrich Muller; and U.S. Pat. No. 6,705,141 B1, granted Mar. 16, 2004, to Dick Jacob, Elrich Muller, and Jeffery D. Plate.

There is a need for providing an improved way of mounting a key and a coil spring for moving the key from a stowed or folded position into an extended position. There is also a need for providing an improved lock for locking the key in the folded position which is easily operable to unlock the key, allowing a spring to move the key from its folded position into its extended position. It is an object of the present invention to fulfill these needs.

Herein the term "key unit" is generic to both a key member having a head and a lock engaging portion extending from the head, and such a key member in combination with a key head holder which receives the head of the key member.

SUMMARY OF THE INVENTION

The key case of the present invention is basically characterized by a housing having at least one key unit receiving cavity and an open end, and a key unit mounting pin extending across the cavity. A key unit is provided that has a mounting opening through which the mounting pin extends. There is a spring in the mounting opening, surrounding the mounting pin. The spring has a first end connected to the housing and a second end connected to the key unit. The key unit is pivotally connected to the housing by the mounting pin, for pivotal movement between a first position in which it is substantially within the key unit receiving cavity, and a second position in which it projects outwardly from the open end of the cavity.

In preferred form, the spring biases the key unit into the second position. The key unit is hand movable from the second position into the first position and said movement of the key unit stores energy into the spring.

Preferably, the key case also includes a releaseable lock for each key unit, for locking the key unit in its first position within the key cavity. The releaseable lock includes a trigger operable to release the releaseable lock. In response to this release, the stored energy in the spring moves the key unit from its first position into its second position.

Preferably, the mounting pin includes a first spring end engaging opening and the key unit includes a second spring end engaging opening. The spring is a coil spring having a first end portion that fits in the first spring end engaging opening and a second end portion that fits in the second spring end engaging opening.

According to an aspect of the invention, the key unit includes a key head holder and a key member having a key head that is within the key head holder, and a lock engaging opposite end portion. According to another aspect of the invention, the key unit is a member that includes a key head and a lock engaging portion. In the first embodiment, the mounting opening is in the key head holder. In the second embodiment, the mounting opening is in the head of the key member.

A key case constructed according to the present invention may include a single key unit receiving cavity in which the head of a key, or a key head holder, is received, or a plurality of key unit receiving cavities, each adapted to receive the head of a different key or a different key head holder.

Other object, advantages and features of the invention will become apparent from the description of the best mode set forth below, from the drawings, from the claims and from the principles that are embodied in the specific structures that are illustrated and described.

BRIEF DESCRIPTION OF THE SEVERAL VIEWS OF THE DRAWING

Like reference numerals are used to designate like parts throughout the several views of the drawing, and:

FIG. 8 is a view at the perimeter of the key holder, showing clips that are used to secure the components of the key unit together;

FIG. 9 is a view looking towards the end of the mounting pin, showing the spring in the opening formed in the key unit and on the mounting pin;

FIG. 10 is a axial sectional view of the mounting pin and the key unit of FIG. 9;

FIG. 11 is a side elevational view of the second embodiment, showing the key unit projecting outwardly from the open end of the housing;

FIG. 12 is a longitudinal sectional view of the second embodiment, showing the key unit in a folded position within the housing;

FIG. 13 is a top plan view of FIG. 11; and

FIG. 14 is a pictorial view of the key unit portion of a second embodiment of the invention.

DETAILED DESCRIPTION OF THE INVENTION

Figure 3:
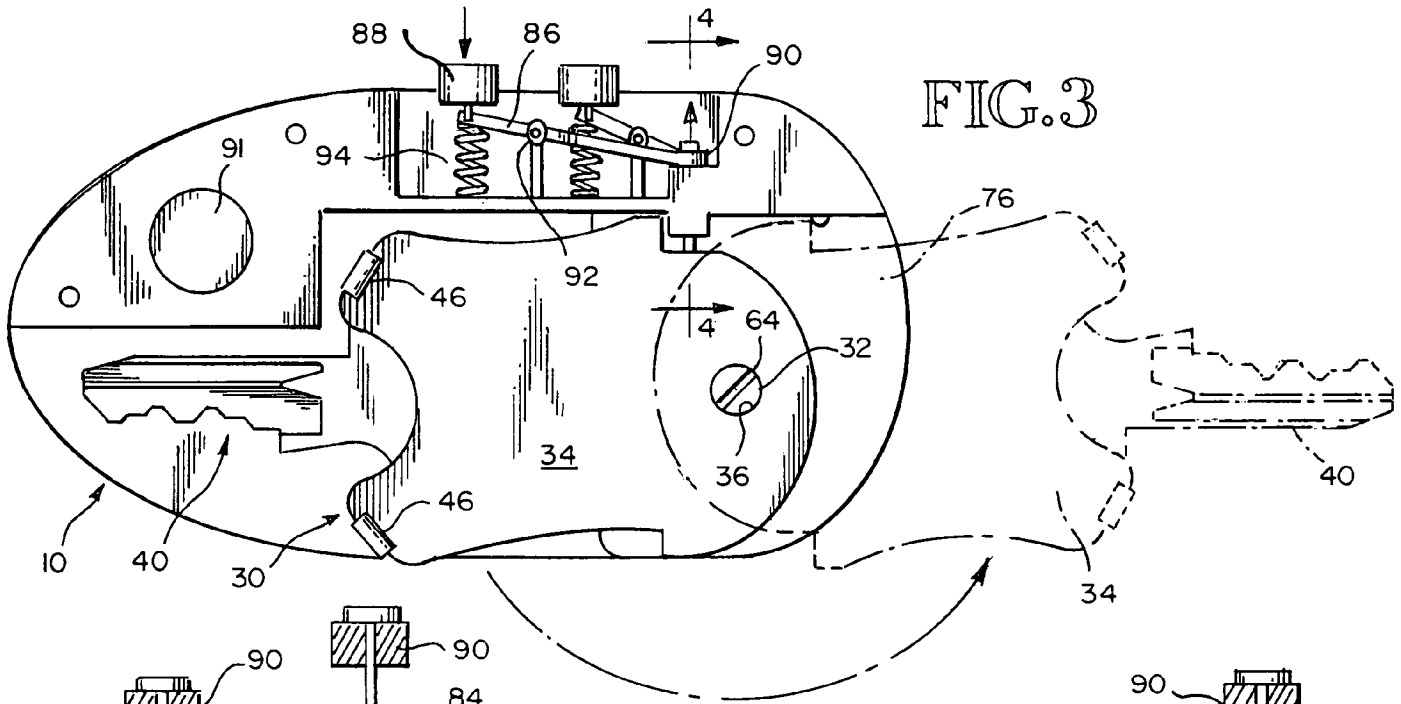
FIG. 3 is a longitudinal view taken through the key case of FIGS. 1 and 2, including a solid line showing of a key unit in a stored position within the housing and a broken line showing of the key unit in an extended position in which it extends out through one end of the housing.

FIGS. 1–9 relate to a first embodiment of the invention. It includes a housing 10 that is similar to the housing of a pocketknife that has several blades. Housing 10 has outer sidewalls 12, 14 and inner partitions 16, 18, 20 which divide the interior of the housing into a plurality of key unit receiving cavities. Specifically, the illustrated embodiment includes four cavities 22, 24, 26, 28. As shown by FIG. 3, each cavity 22, 24, 26, 28 receives its own key unit, the key unit in FIG. 3 being designed 30. A key unit mounting pin 32 extends from a sidewall portion of the cavity laterally across the cavity. The first embodiment includes a key head holder 34 which includes an opening 36 into which the mounting pin 32 extends. A head portion 38 of a key member 40 is located inside of the key head holder 34, between the two sidewalls 42, 44 of the key head holder 34. The key head 38 is placed within the key head holder 34, between the sidewalls 42, 44, and then the sidewalls 42, 44 are brought together and connected together by clips 46 (FIGS. 3 and 8). When the key member 40 is positioned between the two members 42, 44, the openings 48, 50 are moved together and the mounting pin 32 is moved relatively into them. Then, the clips 46 are installed so that the two members 42, 44 are held together and the key head 38 is trapped by and between them. The clips 46 have a first end portion 52 that hinge connects the clips 46 to the member 44 at slots formed in member 44. The opposite end portions 48 of the clips 46 are hooks. They are moved into slots formed for them in the second member 42 See. FIG. 8.

Figure 6:
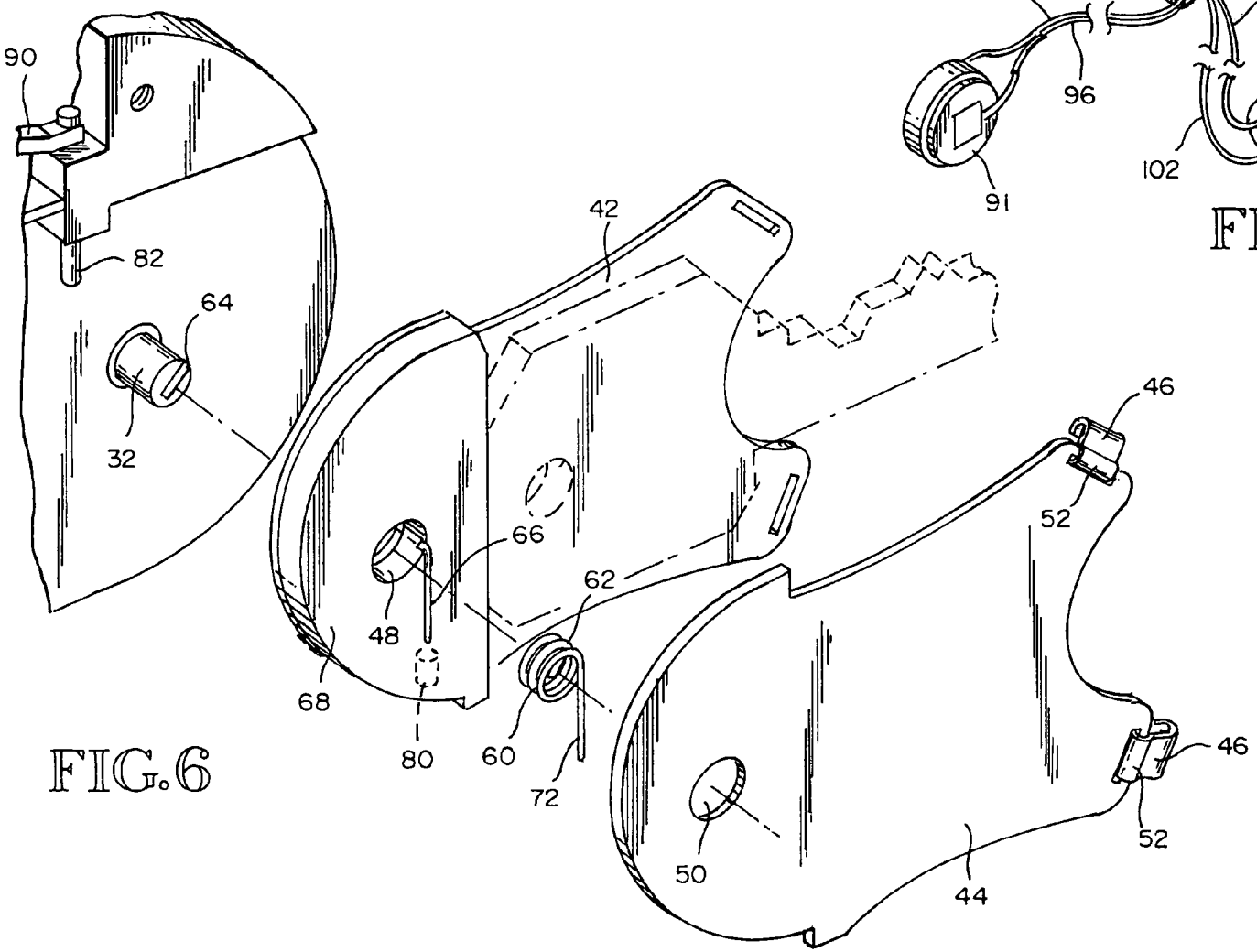
FIG. 6 is an exploded view pictorial view of a portion of the housing and a key holder that is a part of one of the key units.

Each spring 60 has a central coil portion 62 that is within the mounting opening 48 in a surrounding relationship to the mounting pin 32. Referring to FIG. 6, the mounting pin 32 includes a spring-end engaging opening 64, shown in the form of a slot. Key head holder 68 includes a spring-end opening 66 shown in the nature of a groove. Referring to FIG. 9, the spring 60 has a first end portion 70 and a second end portion 72. End portion 70 fits within the spring-end engaging opening 64 and end portion 72 fits within the spring-end engaging opening 66. The mounting pin 32 is fixed against rotation relative to the housing 10. However, the key head holder 34 is rotatable about the axis of the mounting pin 32. When spring-end portion 70 is within spring-end engaging opening 64, the coil portion 62 of the spring 60 is within the openings 48, 50, and the spring-end portion 72 is within the spring-end engaging opening 66. When the key unit is in its extended position, spring 60 is in a static condition. In preferred form, each key head holder 34 includes an end member 68 that is sandwiched between the two side members 42, 44. Member 68 serves as a spacer for spacing the members 42, 44 apart a desired distance. This distance is substantially equal to or slightly greater than the thickness of the key head 38. A lock pin catch, for example, in the form of a socket 80, may be formed in the member 68.

Figure 1:
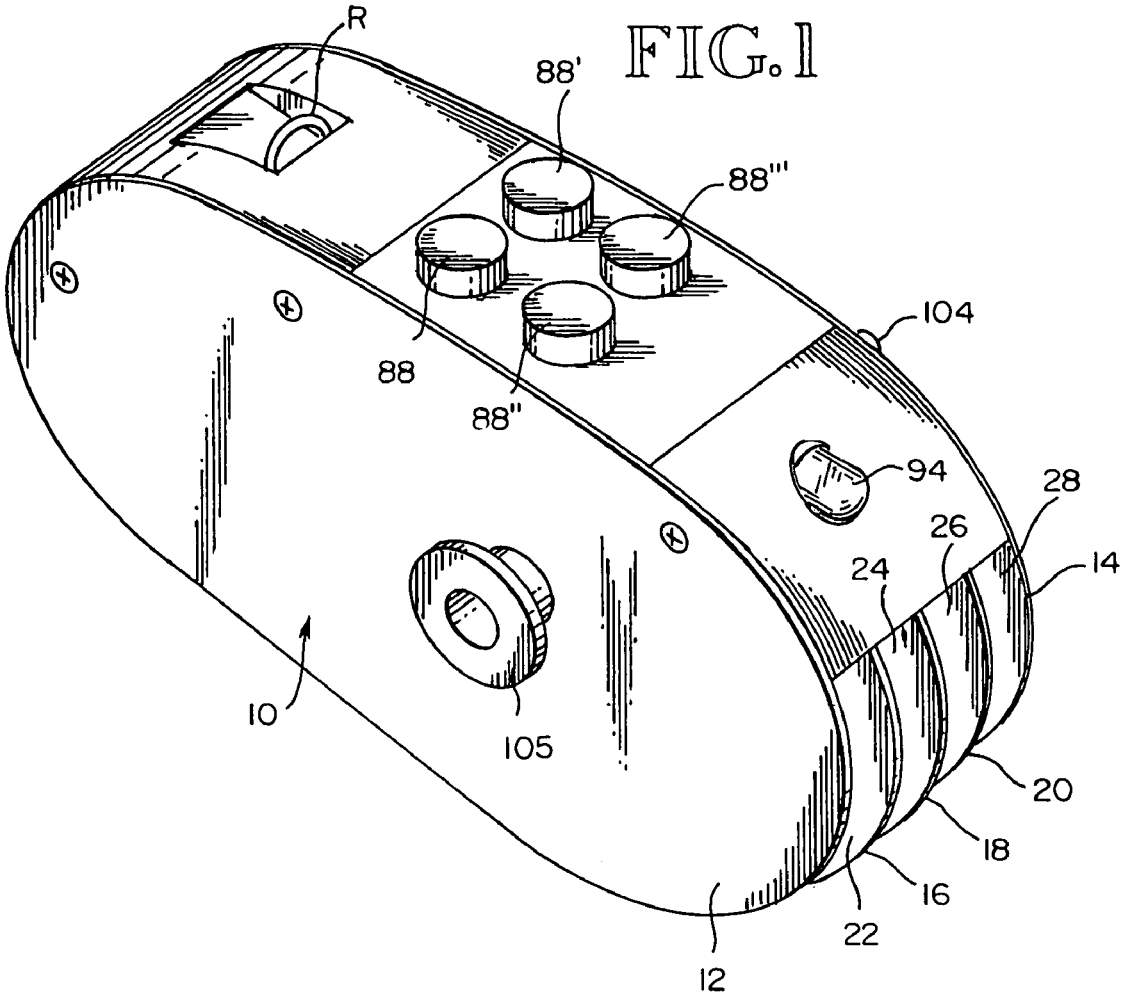
FIG. 1 is a pictorial view taken from above and looking towards the top, one side and one end of an embodiment of the invention, showing a plurality of key units in stored positions within a housing.
Figure 2:
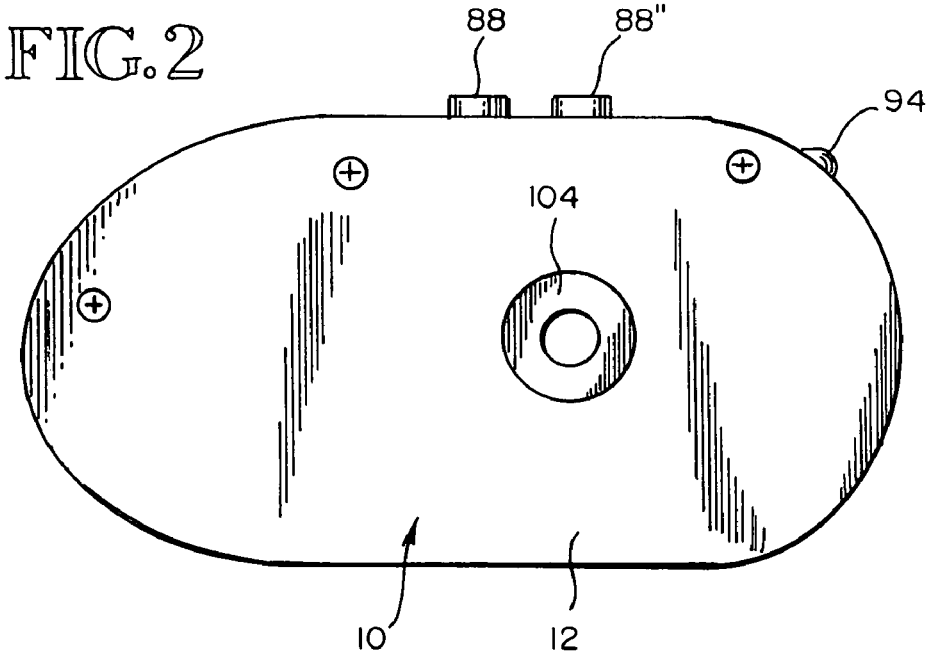
FIG. 2 is a side elevational view of the key case shown by FIG. 1.
Figure 4:
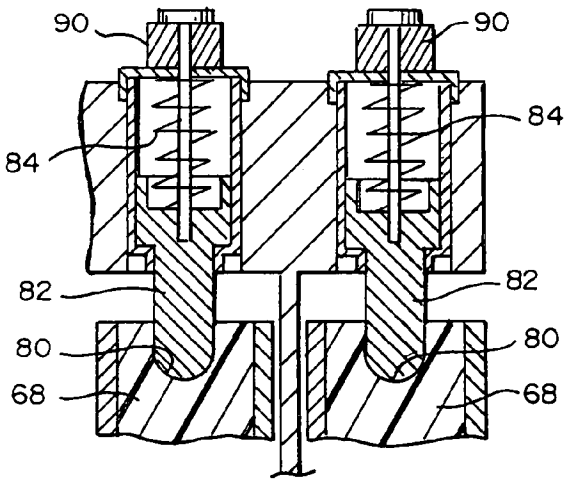
FIG. 4 is a sectional view taken substantially along line 4—4 of FIG. 3, showing two releaseable locks in lock positions.
Figure 5:
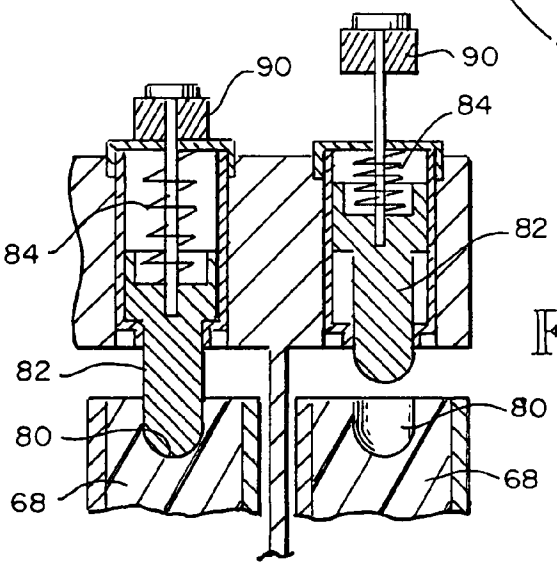
FIG. 5 is a view like FIG. 4, showing one of the releaseable locks in a lock position and the other in an unlock position.

The key case preferably includes a lock mechanism for each key unit. In the embodiment shown by FIGS. 1–7, there are four key units and hence there are four lock mechanisms. As best shown by FIG. 1, the lock mechanisms are mounted in the housing 10 opposite the longitudinal opening in the housing that communicates with the end opening. As best shown by FIGS. 3–5, each mechanism comprises a lock pin 82 that is movable endwise into and out from a socket or catch 80. Each lock pin 82 is backed up by a compression spring 84 that biases the lock pin 82 into the "lock" position. That is a position in which a lock pin extends into the lock pin catch 80. This position of the lock pin 82 is shown on the left in FIG. Sand at both the lock pin locations in FIG. 4. A control lever 86 is associated with each lock pin 82. The lever 86 has a first end that is in contact with a button 88, an opposite end 90 that is connected to a lock pin 82, and a fulcrum 92 between its ends which mounts the lever 86 for pivotally movement about a transverse axis. Another coil spring 94 is positioned in the button end of the lever 86. It biases the assembly into a position with the button 88 up and the lock pin 82 down. The illustrated embodiment holds four key units and four lock mechanisms and hence four buttons. The buttons are designated 88', 88", 88'''.

FIG. 3 shows the key head holder 34 and the lock engaging portion of the key 40 extending endwise outwardly through the end opening of the housing 10. In this position, the spring is relaxed (static) and wants to remain relaxed. As a result, it holds the key unit 34, 40 in the position illustrated at the right end of FIG. 3. However, the key unit 34, 40 can be swung by hand, against the force of the spring, from the position shown on the right to the position shown on the left in FIG. 3. This movement of the key unit 34, 40 from its extended position into its folded position stores energy in the spring 60 by rotating the spring end 72 of that is connected to the key unit 34, 40 while the opposite 60 end spring 70 is anchored by its connection to the pivot pin 32.

As previously stated, the compression spring 94 biases the button end of the lever 86 upwardly and the lock pin end 82 downwardly. When the key unit 34, 40 is in the position shown on the right in FIG. 3, the lock pin 82 is extended adjacent the circular edge boundary of the member 68 that includes the lock pin catch 80. When the key unit 34, 40 is in the position shown on the left in FIG. 3, the lock pin catch 80 is in alignment with the lock 82 and the spring 84 pushes the lock pin 82 into the catch 80. During rotation of the key unit 34, 34 from its extended position into its folded position, the lower end of the lock pin 82 rest on the curved end surface of the member 68. This contact between lock pin 82 and the surface moves the lock pin 82 upwardly against the force of the spring 84, storing energy in the spring 84. Just as soon as the lock pin 82 is alignment with its lock catch 80, the spring 84 acts to extend the lock pin 82 so as to place its end in the lock pin catch 80.

As previously described, the spring 94 biases the button end of the lever 86 upwardly and the lock pin end of the lever 86 downwardly. The lock mechanism will remain in this position and the key unit 34, 40 will be inside of the housing 10 until the button 88 for such a lock mechanism is depressed. As shown by FIG. 3, downward movement on button 88 will move the button end of the lever 86 downwardly and the lock pin end 90 of the lever 86 upwardly. The upward movement of the lever end 90 pulls up on the lock pin 82, lifting it upwardly and retracting it from the lock pin catch 80. Just as soon as the lock pin 82 is out from the lock pin catch 80, the stored energy in the spring 60 acts to rotate the key unit 34, 40 from its folded or stowed position, shown on the left in FIG. 3, to its use or extended position, shown on the right in FIG. 3.

Figure 7:
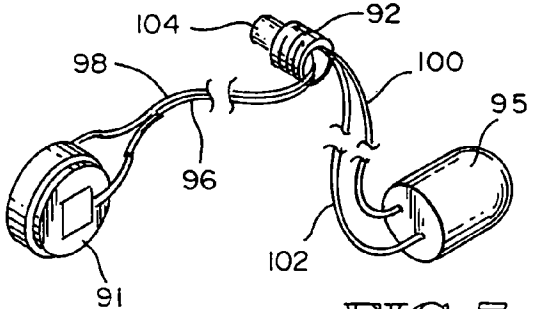
FIG. 7 is a pictorial view of a light, a battery in a switch that are incorporatable into the housing of the key holder.

FIG. 7 is a pictorial view of a battery 91, a switch 92, a light 95 and wires 96, 98, 100, 102. These components form a light that can be incorporated into the housing 10. FIG. 1 shows a location for the light 94. The switch 92 may be incorporated into another portion of the housing 10, with its control button 104 projecting outwardly from the housing 10. The battery 91 and the wires 96, 98, 100, 102 are also within the housing 10. Battery 91 may be in cavity formed in the housing. Part 105 may be a connector for receiving a carrying strap (not shown). Ring R, shown in FIG. 1, may be connected to a line.

FIGS. 10–14 illustrate a second embodiment of the invention. This embodiment includes a single key unit that is in the form of a key member 40' having a key head 38' and a key engaging portion. As shown by FIGS. 10, 12 and 14, the housing 10' includes a key unit receiving cavity 30' and a key unit mounting pin 32'. FIG. 12 shows the key member 40' in its folded or stowed position. FIGS. 11 and 13 show the key member 40' in its extended position. Key member 40' includes a mounting opening 110 which receives the mounting pin 32' as best shown by FIG. 10, mounting pin 32' includes a spring end receiving opening in the nature of a slot 64'. The key member includes another spring end slot 66'. Spring 60 includes a first spring end portion 70 and a second spring end portion 72. Spring end portion 70 fits within slot 64'. Spring end portion 72 fits within slot 66'. See FIG. 10. Washers 41, 43 are outwardly of the opposite ends of opening 110. As shown by FIG. 10, washers 41, 43 keep spring 60 within the opening 110.

As in the first embodiment, the spring 60 is relaxed when the key member 40 is in its extended position (FIG. 12). Key member 40' is hand movable from its extended position into its folded position (FIG. 12). This swinging movement of the key member 40' twists the spring 60, storing energy in it. When the key member 40' is in its folded position, the lock pin 88 enters into the lock pin catch. In this embodiment, the lock pin catch 94 is formed in the key head 38' (FIG. 12). A single lock mechanism is provided and it is made up of the elements 82, 86, 88, 90, 92 and 94. When the key member 40' is in its folded position, the lock pin 82 enters into the lock pin catch 94 and locks the key member 40' in the folded position. As in the first embodiment, when the lock release button 88 is depressed, it swings lever end 90 upwardly, pulling the lock pin 82 out from the lock pin catch. This release of the lock pin 82, allows the stored energy in the spring 60 rotate the key member 40' from its folded or stowed position (FIG. 12) into its extended position (FIGS. 11 and 13).

The illustrated embodiments are only examples of the present invention and, therefore, are non-limitive. It is to be understood that many changes in the particular structure, materials and features of the invention may be made without departing from the spirit and scope of the invention. Therefore, it is my intention that my patent rights not be limited by the particular embodiments illustrated and described herein, but rather are to be determined by the following claims, interpreted according to accepted doctrines of patent claim interpretation, including use of the doctrine of equivalents and reversal of parts.

What is claimed is:

1. A key case, comprising:

a housing including a top and sidewalls together forming a key unit receiving cavity in the housing, said cavity being open at the bottom and one end of the housing to define a key path into and out from the key unit receiving cavity;

a key unit mounting pin extending from one sidewall across the cavity, said key unit mounting pin having a longitudinal slot open along one side of the pin and at the outer end of the pin;

a key unit having a mounting opening through which the mounting pin extends;

a coil spring in said mounting opening directly surrounding the mounting pin, said coil spring having a first end portion that extends diametrically across the spring into the slot in the mounting pin;

said spring having a second end portion that is connected to the key unit and moves with the key unit;

said key unit being pivotally connected to the housing by said mounting pin, for pivotal movement of the key unit between a first position in which the key unit is substantially within the key unit receiving cavity, and a second position in which the key unit projects endwise outwardly through the open end of the cavity;

wherein movement of said key unit from the second position into the first position, stores energy in the spring for biasing the key unit toward its second position; and a releasable lock for locking the key unit in its first position, said releasable lock when released unlocking the key unit so that the stored energy in the spring will move the key unit from its first position into its second position.

2. The key case of claim 1, wherein the releasable lock includes a push button mounted in the top of the housing, said push button being biased into an "up" position and being depressible to a "down" position in which it unlocks and releases the key unit, allowing the stored energy in the spring to swing the key unit from its first position into its second position.

3. The key case of claim 1, wherein the key unit includes a key head holder and a key having a key head in the key head holder.

4. The key case of claim 3, wherein the key head holder has first and second side portions and the key head is positioned between them.

5. The key case of claim 4, wherein the key head holder includes a slot and the second end portion of the spring extends into the slot for connecting the second end of the coil spring to the key unit.

6. The key case of claim 1, wherein the key unit is a key member having a head portion and a lock engaging portion extending from the head portion, and said head portion includes the mounting opening.

7. The key case of claim 6, wherein the key head includes a side slot and the second end portion of the spring is positioned within the slot for connecting the second end portion of the coil spring to the key unit.

8. The key case of claim 1, wherein the key unit and spring are slidable onto and off from the mounting pin, and wherein the first end portion of the spring moves axially into and out from the slot in the mounting pin when the key unit is installed onto and removed from the mounting pin.

9. The key case of claim 8, wherein the key unit includes a key head holder and a key having a key head in the key head holder.

10. The key case of claim 9, wherein the key head holder has first and second side portions and the key head is positioned between them.

11. The key case of claim 10, wherein the key head holder includes a slot and the second end portion of the spring extends into the slot for connecting the second end of the coil spring to the key unit.

12. The key case of claim 8, wherein the key unit is a key member having a head portion and a lock engaging portion extending from the head portion, and said head portion includes the mounting opening.

13. The key case of claim 12, wherein the key head portion includes a slot and the second end portion of the spring is positioned within the slot for connecting the second end portion of the coil spring to the key unit.

* * * * *